United States Patent [19]

Bond

[11] Patent Number: 4,912,959

[45] Date of Patent: Apr. 3, 1990

[54] OVERHEAD MAGNETIC BLANK UNLOADING CONVEYOR

[76] Inventor: Irvin D. Bond, 1027 Allen Rd., Clarkston, Mich. 48016

[21] Appl. No.: 262,739

[22] Filed: Oct. 26, 1988

[51] Int. Cl.[4] ..... B21D 45/00

[52] U.S. Cl. ..... 72/426; 83/112; 198/679

[58] Field of Search ..... 83/82, 112, 155; 198/679; 72/361, 426

[56] References Cited

U.S. PATENT DOCUMENTS 2,867,185 1/1959 Hayward ..... 72/426

2,976,753 3/1961 Fowler et al. ..... 83/112

3,505,918 4/1970 Schneider ..... 83/112

3,847,269 11/1974 Buccicone ..... 198/679

*Primary Examiner*—Lowell A. Larson

*Attorney, Agent, or Firm*—Charles W. Chandler

[57] ABSTRACT

A conveyor belt apparatus is mounted between the upper and lower die shoes of a press for removing a metal blank from the press. The conveyor has magnetic means for magnetically attracting the workpiece to the underside of the belt as it is being moved from the press at right angles from the direction the sheet metal is fed into the press.

16 Claims, 2 Drawing Sheets

OVERHEAD MAGNETIC BLANK UNLOADING CONVEYOR

This invention is related to conveyor apparatus mounted in a power-operated press for removing a sheet metal blank from the press.

Sheet metal blanks are commonly formed from a coil of sheet metal fed into a press. The press has a cutting die that is lowered to cut the blank from the sheet metal. The blank is then unloaded from the press, 90 degrees from the coil feed direction, either by gravity, or by being pushed out by air cylinder kickers. These methods are slow and the light gage sheet metal is subject to damage.

SUMMARY OF THE INVENTION

The broad purpose of the present invention is to provide means for removing a blank from a press by lifting the blank to a magnetic belt conveyor. At each stroke of the press, a blank is lifted to overhead belts running perpendicular to the coil feed direction.

One or more conveyor belts may be mounted in the press for unloading the blank. Each belt has magnetic means for attracting the blank to the underside of the belt. The blank is raised to the belt by vacuum cup pick-up means mounted on the upper die.

As the upper die shoe is lowered in a cutting motion, the vacuum pick-up cups engage the blank. As the upper die shoe is raised after the blank has been cut, the vacuum cups lift the blank until it engages the underside of the belt. The magnetic belt conveyor then removes the blank from the press.

The length of the belts can be adjusted to accommodate the particular configuration of the blank. The number of belts and the distance between the belts is also chosen to accommodate the position and size of the blank.

The magnetic conveyer rapidly clears the press of the blank, clear of incoming coil stock. The press can run at cycle rates, unimpeded by blank evacuation. The incoming coil end passes below the outgoing blank. The fast action of the system permits the press to run continuously and can remove a large blank, such as a fender or quarter panel in less than a second. The preferred conveyor provides increased productivity, damage-free flanks, improved quality, elimination of kickers and related controls, and is easily adapted to stacking systems.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
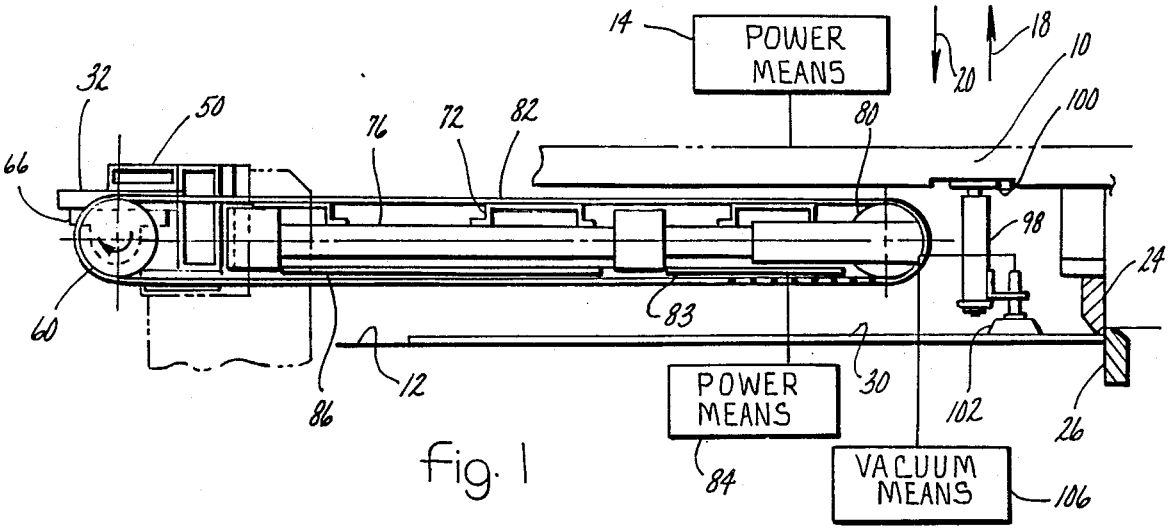
FIG. 1 is a view of a conveyor apparatus mounted between the upper and lower die shoes of a press, adjacent the pick-up position of the blank.
Figure 2:
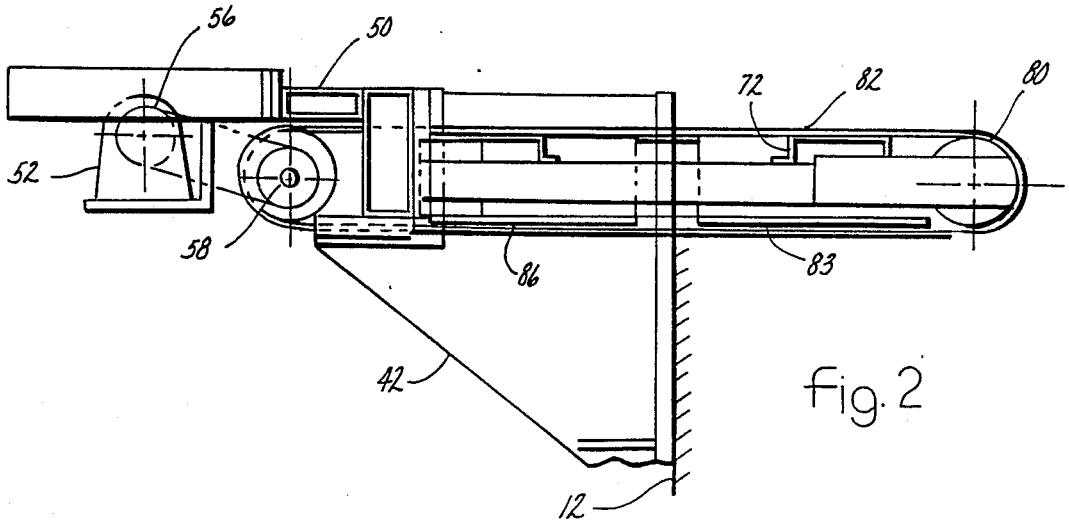
FIG. 2 is a view similar to FIG. 1, but showing an alternative means for mounting the conveyor on the lower die shoe.

Referring to FIGS. 1 and 2, a conventional press apparatus 8 is illustrated having an upper die shoe 10 and a lower die shoe 12. The upper die shoe is raised and lowered in the conventional manner by power press ram means 14 for performing a cutting operation on magnetically-attractive sheet metal 16. The power means raises the upper die shoe to permit sheet metal 16 to be advanced to a cutting position in the press. The upper die shoe is raised in the direction of arrow 18 (FIG. 1) and then lowered in a power stroke in the direction of arrow 20 toward the lower die shoe.

The sheet metal is fed from a coil, not shown, from the bottom side of FIG. 2 and then advanced in the direction of arrow 22. When the sheet metal has reached the cutting position illustrated in FIG. 4, a pair of conventional cutting means 24 and 26 (FIG. 1), carried on the upper and lower die shoes, respectively, cut the sheet metal to form a blank with the configuration illustrated at 30 in FIG. 4.

Figure 4:
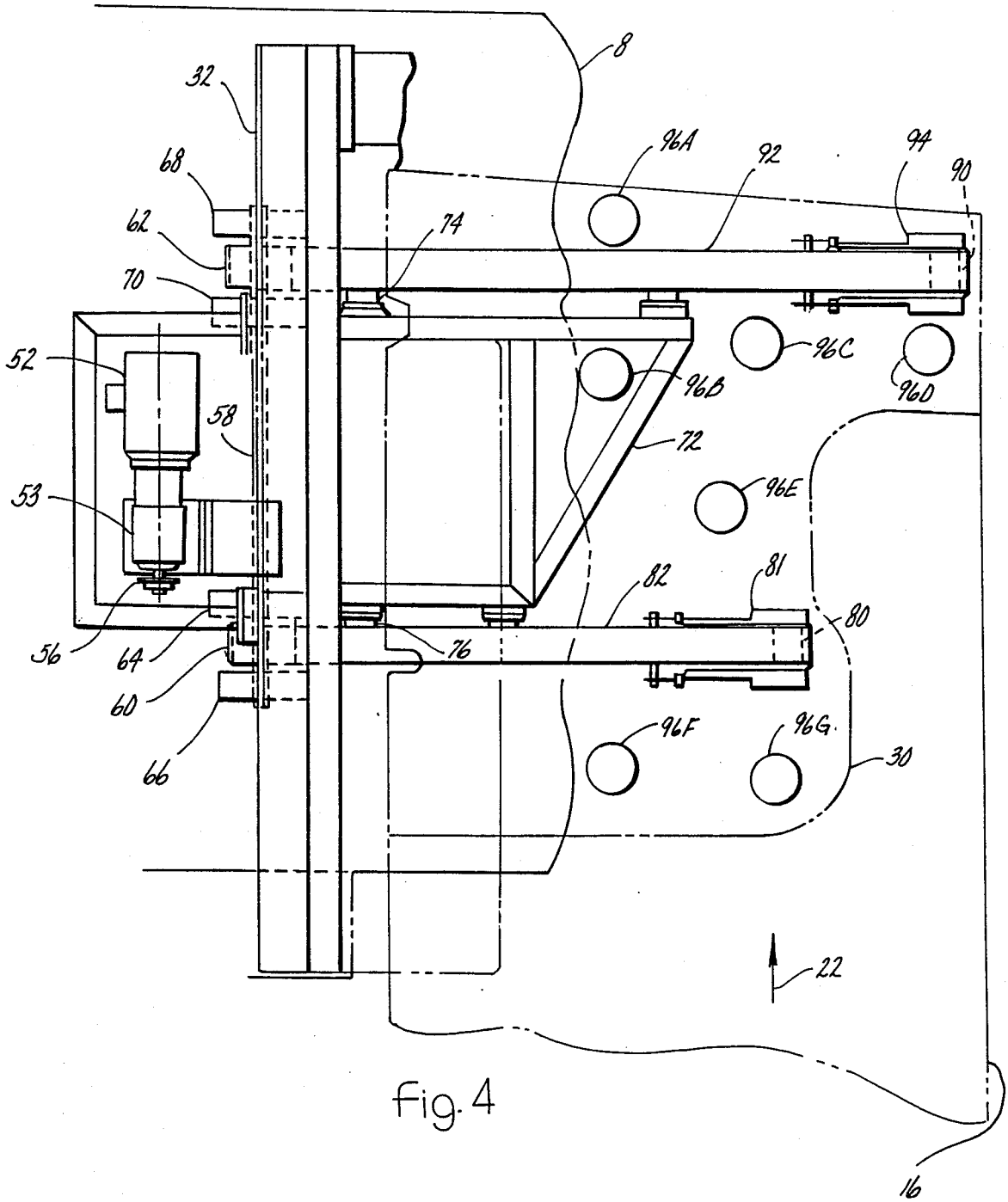
FIG. 4 is a plan view of the preferred conveyor apparatus mounted in a press.

The blank, formed from the sheet metal, is then removed toward the left, as viewed in FIGS. 1 and 4, by conveyor apparatus, generally indicated at 32.

Figure 3:
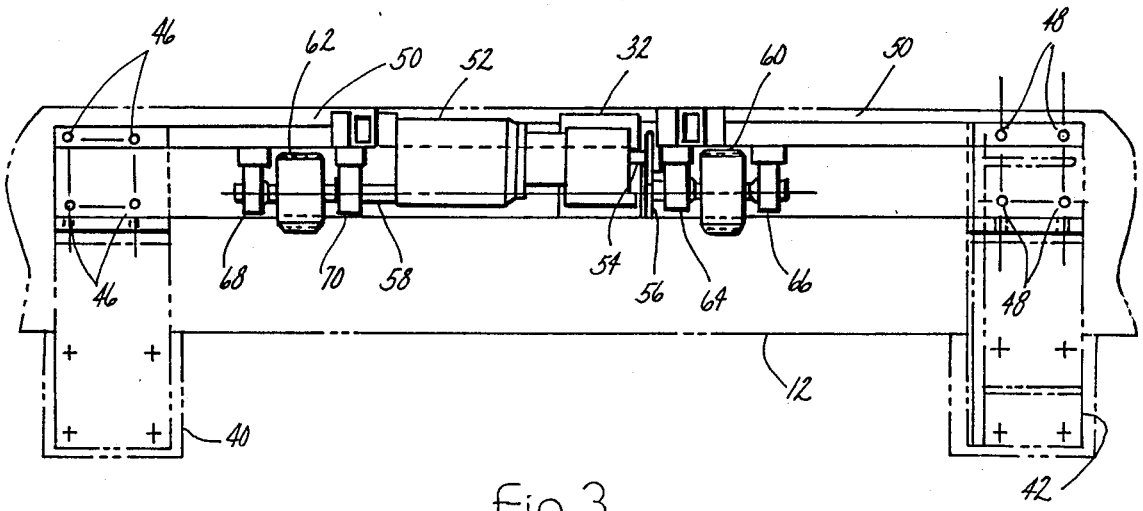
FIG. 3 is a view generally as seen from the left side of FIG. 1.

Referring to FIGS. 3 and 4, the conveyor apparatus includes a pair of brackets 40 and 42 attached by fastener means 46 and 48, respectively, to the lower die shoe. An elongated bridge structure 50 has its ends attached to brackets 40 and 42. An electrically-actuated motor 52 is mounted on the midsection of the bridge structure. The motor is connected to gear box 53 which has an output shaft 54 drivingly connected by chain and sprocket means 56 to drive shaft 58. One end of shaft 58 is drivingly connected to a conveyor pulley 60, and the opposite end of the shaft is drivingly connected to a conveyor pulley 62. Conveyor shaft 58 is supported on four bearing means 64, 66, 68, and 70.

A support structure 72 is carried on the bridge and supported in a cantilever fashion between the upper and lower die shoes, as best illustrated in FIGS. 1 and 4. The support structure carries an elongated conveyor support means 74 and 76.

Conveyor pulley 60 is mounted on drive shaft 58, and a second conveyor pulley 80 is mounted on the opposite end of support structure 76. A urethane belt 82 is wrapped around the two pulleys 60 and 80 to travel between the two pulleys. Pulley 60 is driven in the clockwise direction as viewed in FIG. 1. An appropriate tightening means 81 is mounted on the conveyor structure for tightening the belt in the conventional manner.

The end of the conveyor belt wrapped around pulley 80 is inside the press, between the upper die shoe and the lower die shoe, while conveyor pulley 60 is outside the press, remote from pulley 80.

Referring to FIG. 1, an elongated electro-magnet means 83 is mounted on conveyor support structure 76, within the loop formed by the belt, and adjacent pulley 80. Power means 84 provide means for energizing and adjusting the electro-magnetic strength of magnet 83. An elongated permanent magnet 86 is mounted on the conveyor structure within the belt loop, between pulley 60 and electro-magnet 83.

This conveyor structure is mounted between the pick-up position of blank 30 and the upper die shoe which carries cutting means 24.

Referring to FIG. 4, conveyor support structure 72 supports another pulley 90 that is remote from drive pulley 62 and 90. A urethane conveyor belt 92 is wrapped around pulleys 62 and 90. The distance between pulleys 90 and 62 is greater than the distance between pulleys 80 and 66.

Tightening means 94 is adapted to tighten belt 92. Belt 92 is parallel to belt 82. The distance between the two belts can be adjusted as well as the respective length of the two belts to accommodate the configuration of the sheet metal blank. It is to be noted that the inner pulley of each belt is closely adjacent the cut portion of the blank.

The second belt 92 is supported adjacent magnetic pickup means, not shown, similar to that of belt 82.

Referring to FIG. 4, seven vacuum pick-up devices 96A through 96F are mounted on the upper die shoe, spaced according to the configuration of the blank to provide a relatively uniform pick-up. A typical pick-up device 96F is illustrated in FIG. 1 and comprises an elongated vertical support 98 having its upper end connected in a recess 100 of the upper die shoe. A spring-loaded vacuum cup 102 is mounted on the lower end of member 98 so as to be resiliently moveable in a direction perpendicular to the surface of blank 30. Vacuum means 106 is connected to the seven vacuum cups which are arranged such that as the upper die shoe is lowered, the cups collectively engage the blank just before cutting means 24 and 26 severe the blank around is border.

Upon completion of the cutting stroke, the upper die is raised in direction 18 thereby lifting the blank until it engages the lower horizontal sides of the two conveyor belts. The vacuum cups then release the blank. As the blank is being raised toward the conveyor belts, the electro-magnets are energized so as to attract the blank toward the belts.

The belts are then driven by drive pulleys 60 and 62 and motor 52 to unload the blank from the press, in a direction at right angles to the direction 22 of the sheet metal being fed into the press.

Referring to FIG. 1, as the blank is carried from pulley 80 toward pulley 62, the steel blank approaches permanent magnet 86 which maintains the metal blank attracted to the belt. The electro-magnet is then de-energized. The strength of the electro-magnets on each of the conveyors can be adjusted to accommodate the weight and configuration of the blank. Further, the pick-up strength of the electro-magnets on the two conveyors is adjusted to eliminate any tendency of the blank to waffle as it is being lifted and carried from the press. The blank is then removed from the press and the operation repeated during the next blank cutting cycle, as the incoming coil end passes below the outgoing blank.

FIG. 3 illustrates how bracket means 40-42 support the bridge structure 50 to the lower die shoe 12 of the press.

Having described my invention, I claim:

1. In a press apparatus having a lower die shoe, and an upper die shoe moveable with respect to the lower die shoe in a power stroke, and a magnetically-attractive workpiece movable to a pick-up position between said upper die shoe and said lower die shoe, the combination comprising:

a first belt conveyor means including an elongated conveyor belt having a first end disposed between said upper die shoe and said lower die shoe inside the press apparatus adjacent said pick-up position at such times as the upper die shoe is moving toward said conveyor belt first end in power stroke, and a second end supported in a transfer position outside the press and remote from the first end, and means for moving the first end of the belt from the pick-up position to said transfer position;

first means carried on the upper die shoe operative to engage the workpiece as the upper die shoe is moving toward the lower die shoe, and moving the workpiece toward the belt as the upper die shoe is moving away from the lower die shoe; and magnetic means mounted on the belt conveyor means for retaining the workpiece in engagement with the belt as it is being moved from said pick-up position to said transfer position, to remove the workpiece from the press apparatus.

2. A combination as defined in claim 1, in which the first means comprises a vacuum-operated pick-up means carried on the moveable upper die shoe.

3. A combination as defined in claim 1, in which the magnetic means comprises first electro-magnet means carried on the conveyor means adjacent said first belt end, and means for energizing the first electro-magnet means as the workpiece is being raised toward the conveyor belt.

4. A combination as defined in claim 3, including permanent magnet means mounted on the conveyor means between the first belt end and the first electro-magnet means, and means for de-energizing the electro-magnet means when the workpiece has been moved by the belt to a position in which the workpiece is retained in contact with the belt by the permanent magnet means.

5. A combination as defined in claim 5, in which the belt has an upper section and a parallel, lower section, and the workpiece is attracted to the underside of the lower section.

6. A combination as defined in claim 3, including power means for adjusting the magnetic strength of the electromagnet.

7. A combination as defined in claim 1, in which the first belt conveyor means includes a second elongated belt disposed between the pick-up position of the workpiece and the upper die shoe, for assisting the first conveyor belt in removing the workpiece from the pick-up position to a position remote therefrom.

8. A combination as defined in claim 7, in which the second conveyor belt is supported parallel to said first mentioned conveyor belt.

9. A combination as defined in claim 7, in which the second conveyor belt has a greater length than the first mentioned conveyor belt.

10. In combination with a press apparatus having an upper die shoe, and a lower die shoe, the upper die shoe being moveable toward the lower die shoe in a power stroke, and including workpiece-cutting means on the upper die shoe operative to cut a magnetically-attractive blank from a sheet metal workpiece disposed between the upper die shoe and the lower die shoe as the upper die shoe is being moved toward the lower die shoe;

a belt conveyor means including an elongated belt having a first end disposed between said upper and lower die shoes during said power stroke, and a second end supported in position remote from the first end for removing the blank in a first direction from a blank pick-up position, the belt including an upper belt section and a lower belt section generally parallel to the upper belt section, and magnetic means carried on the conveyor means for attracting the blank to the underside of the lower belt section.

11. A combination as defined in claim 10, including vacuum cup pick-up means carried on the upper die shoe for engaging the blank and for raising the bank toward the underside of the conveyor belt as the upper die shoe is being raised.

12. A combination as defined in claim 10, in which the workpiece is fed in a first direction into the press apparatus, and the blank is removed in a second direction, 90 degrees with respect to said first direction, from the press apparatus.

13. Conveyor apparatus for moving a magnetically attractive workpiece from a first workpiece position toward a second work-piece position along a path of motion, comprising:

conveyor support means;

an elongated conveyor belt, and means for moving a section of said belt from a position proximate said first workpiece position to a position proximate the second workpiece position;

a first magnet, and means supporting same adjacent to the belt to bias the workpiece toward the belt to contact same;

a second magnet and means for supporting same adjacent the belt to bias the workpiece toward the belt to contact same;

the first magnet being aligned with the second magnet adjacent the path of motion of the workpiece whereby the belt moves the workpiece, at such times as the workpiece is in contact with the belt, along said path of motion from a position in which the workpiece is biased by the first magnet to contact the belt to a position in which the workpiece is biased by the second magnet to contact the belt;

one of said magnets being a permanent magnet, the other of said magnets being an electromagnet and including means connected thereto for energizing same to move the workpiece between a position in contact with the belt and a position spaced with respect to the belt.

14. A conveyor apparatus as defined in claim 13, in which the control means are adapted to energize the electromagnet to bias the workpiece toward the belt.

15. In a press apparatus having a lower die shoe, and an upper die shoe vertically moveable in a downward direction in a power stroke toward the lower die shoe and a workpiece disposed in a workpiece position, the upper die shoe being moveable in an upward direction in a return stroke, away from the lower die shoe and the workpiece position, the combination comprising:

elongated frame means mounted on the press apparatus such that a first end thereof is disposed in a position in the press apparatus between the upper die shoe and the lower die shoe, adjacent said workpiece position, the frame means having a second end disposed outside of the press apparatus;

a first conveyor pulley disposed on the first end of the frame means and supported in a cantilever manner, in the press apparatus;

a second conveyor pulley disposed on the second end of the frame means outside of the press apparatus;

an elongated moveable conveyor belt wrapped around the first and second conveyor pulleys to form a generally horizontal lower belt span between said pulleys;

ram means for lowering the upper die shoe toward the workpiece and the first conveyor pulley in said power stroke;

vacuum-operated pick-up means carried by the upper die shoe for engaging the workpiece during the power stroke of the upper die shoe, and operative to raise the workpiece toward the lower span of the conveyor belt in the return stroke of the upper die shoe; and magnetic means mounted on the conveyor means for retaining the workpiece in engagement with the lower belt span to move the workpiece along a path of motion in a direction from the first conveyor pulley toward the second conveyor pulley, to remove the workpiece from the press apparatus.

16. A combination as defined in claim 15, in which the magnet means comprises:

a first magnet mounted on the conveyor means adjacent the lower span of the belt to bias the workpiece toward the belt to contact same;

a second magnet and means for supporting same adjacent the belt to bias the workpiece toward the belt to contact same;

the first magnet being aligned with the second magnet adjacent the path of motion of the workpiece as it is being removed from the press, whereby the belt moves the workpiece, at such times as the workpiece is in contact with the belt along said path of motion from a first position in which the workpiece is biased to the lower span of the belt by the first magnet to a second position in which the workpiece is biased to the lower span of the belt by the second magnet; and one of said magnets being a permanent magnet, the other of said magnets being an adjustable electromagnet having an adjustable pick-up strength to accommodate the weight and configuration of the workpiece.

* * * * *